US005421990A

United States Patent [19]

Hahn et al.

[11] Patent Number: 5,421,990

[45] Date of Patent: Jun. 6, 1995

[54] PRODUCTION OF SHINING SHAPED ARTICLES COATED WITH ZINE OR A ZINC ALLOY

[75] Inventors: Erwin Hahn, Heidelberg; Bernhard Dung, Gruenstadt; Bernd Burkhart, Maxdorf; Chung-Ji Tschang, Bad Duerkheim, all of Germany

[73] Assignee: BASF Aktiengesellschaft, Ludwigshafen, Germany

[21] Appl. No.: 140,178

[22] PCT Filed: May 6, 1992

[86] PCT No.: PCT/EP92/00983

§ 371 Date: Nov. 9, 1993

§ 102(e) Date: Nov. 9, 1993

[87] PCT Pub. No.: WO92/22683

PCT Pub. Date: Dec. 23, 1992

[30] Foreign Application Priority Data

Jun. 12, 1991 [DE] Germany ..... 41 19 341.5

[51] Int. Cl.[6] ..... C25D 3/22; C25D 3/56

[52] U.S. Cl. ..... 205/246; 205/245; 205/314

[58] Field of Search ..... 205/244, 245, 246, 311, 205/314

[56] References Cited

U.S. PATENT DOCUMENTS

| | | | |
|---|---|---|---|
| Re. 27,999 | 4/1974 | Korpiun et al. | 204/55 R |
| 4,422,908 | 12/1983 | Welch | 204/55 R |
| 4,528,075 | 7/1985 | Anchor | 204/55 R |

*Primary Examiner*—John Niebling
*Assistant Examiner*—Edna Wong
*Attorney, Agent, or Firm*—Oblon, Spivak, McClelland, Maier & Neustadt

[57] ABSTRACT

The production of shining shaped articles coated with zinc or a zinc alloy by electrodeposition of zinc or a zinc alloy from acidic aqueous electrolytic baths which contain as essential components one or more zinc salts and, where appropriate, salts of the other alloy metals, one or more conducting salts, one or more surfactants and one or more brighteners, entails employing as brighteners compounds of the formula I

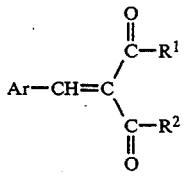

I where $R^1$ is $C_1$–$C_8$-alkoxy, phenoxy, benzyloxy, amino, $C_1$–$C_6$-alkylamino or di($C_1$–$C_6$)alkylamino, $R^2$ is $C_1$–$C_4$-alkyl, phenyl, benzyl or the meanings of $R^1$, and Ar is phenyl or naphthyl which can additionally be substituted by one to three $C_1$–$C_4$-alkyl groups or $C_1$–$C_4$-alkoxy groups.

5 Claims, No Drawings

PRODUCTION OF SHINING SHAPED ARTICLES COATED WITH ZINE OR A ZINC ALLOY

The present invention relates to an improved process for the production of shining shaped articles coated with zinc or a zinc alloy by electrodeposition of zinc or a zinc alloy from acidic aqueous electrolytic baths.

In the electrodeposition of zinc or zinc alloys on metal substrates from acidic aqueous solution it is frequently the aim to produce a shining coating in order to confer an advantageous decorative appearance on the zinc-coated item, ie. a decorative effect is often required in addition to the prevention of corrosion. In order to achieve the required effects it is indispensable for the electrolytic baths to contain certain auxiliaries because otherwise the zinc coatings produced from acidic solution are usually dull and often irregular. Examples of one group of auxiliaries for acidic electrolytic baths are conducting salts which are employed to improve the conductivity of the baths, and another group of auxiliaries comprises the brighteners.

U.S. Pat. No. 3,694,330 (1) (reissue 27 999) describes acidic electrolytic zinc baths which contain ammonium salts and, as brighteners, aromatic carbonyl compounds. Specified as the latter are aromatic carboxylic acids and aromatic aldehydes and ketones. Explicitly mentioned are, inter alia, cinnamic acid, cinnamaldehyde, benzoic acid, benzalacetone and ethyl benzoylacetate.

U.S. Pat. No. 4,422,908 (2) describes acidic electrolytic zinc baths which contain sulfamate ions and, as brighteners, aromatic carbonyl compounds. Aldehydes and ketones are mentioned, including benzalacetone as preferred substance.

The principal representative of the brighteners for acid zinc baths is benzylideneacetone (benzalacetone). A serious disadvantage of benzylideneacetone and its homologs is, however, the fact that these compounds cause allergic reactions, such as skin rashes and itching, in many of those using them.

It is an object of the present invention to replace brighteners based on benzylideneacetone in acidic aqueous electrolytic baths for the deposition of zinc or zinc alloys by other substances which are as effective as the known brighteners but do not have adverse effects on the health of those who use these substances.

We have found that this object is achieved by a process for the production of shining shaped articles coated with zinc or a zinc alloy by electrodeposition of zinc or a zinc alloy from acidic aqueous electrolytic baths which contain as essential components one or more zinc salts and, where appropriate, salts of the other alloy metals, one or more conducting salts, one or more surfactants and one or more brighteners, which comprises employing as brighteners compounds of the formula I

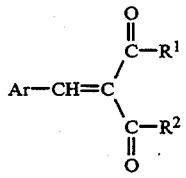

I where $R^1$ is $C_1$–$C_8$-alkoxy, phenoxy, benzyloxy, amino, $C_1$–$C_6$-alkylamino or di($C_1$–$C_6$)alkylamino, $R^2$ is $C_1$–$C_4$-alkyl, phenyl, benzyl or the meanings of $R^1$, and Ar is phenyl or naphthyl which can additionally be substituted by one to three $C_1$–$C_4$-alkyl groups or $C_1$–$C_4$-alkoxy groups.

Preferred meanings of $R^1$ are $C_1$–$C_8$-alkoxy such as n-propoxy, isopropoxy, n-butoxy, isobutoxy, sec-butoxy, tert-butoxy, n-pentoxy, n-hexoxy, n-heptoxy, 2-ethyl-hexoxy, octyloxy and, in particular, methoxy and ethoxy.

Preferred meanings of $R^2$ are $C_1$–$C_4$-alkyl such as ethyl, n-propyl, isopropyl, n-butyl, isobutyl, sec-butyl, tert-butyl and, in particular, methyl, and $C_1$–$C_6$-alkoxy such as n-propoxy, isopropoxy, n-butoxy, isobutoxy, sec-butoxy, tert-butoxy, n-pentoxy, n-hexoxy and, in particular, methoxy and ethoxy.

The preferred meaning of Ar is phenyl, which can additionally be substituted by one or two methyl, ethyl, methoxy or ethoxy groups, but especially unsubstituted phenyl.

Very particularly preferred compounds I are methyl and ethyl 2-benzylideneacetoacetate ($R^1=OCH_3$ and $OC_2H_5$ respectively, $R^2=CH_3$, Ar=Ph) and dimethyl and diethyl 2-benzylidenemalonate ($R^1=R^2=OCH_3$ and $OC_2H_5$ respectively, Ar=Ph).

These substances can be obtained easily and at low cost by condensation of benzaldehyde with the appropriate acetoacetic or malonic ester. The preparation of methyl benzylideneacetoacetate is described, for example, in J. Org. Chem. 55. (1990) 319–324.

The compounds I are employed in the acidic aqueous electrolytic baths according to the invention in an amount of, expediently, from 0.05 g to 3 g per liter, preferably 0.05 to 1 g per liter, in particular 0.1 g to 0.7 g per liter.

It is, of course, possible to employ mixtures of compounds I as brighteners, and to use the brighteners of the formula I together with other known brighteners.

The acidic aqueous electrolytic baths according to the invention have conventional compositions in respect of the other components. They contain, for example, from 50 to 150 g/l of zinc chloride or the equivalent amount of zinc sulfate. Where the intention is to deposit alloys of zinc, for example with cobalt and/or nickel, on metallic substrates, the baths additionally contain as a rule from 1 to 30 g/l cobalt and/or nickel sulfate or the equivalent amount of another water-soluble cobalt and/or nickel salt.

Another essential component of the baths are conducting salts. One suitable conducting salt is potassium chloride which is present in amounts of, usually, from 100 to 250 g/l in the acidic aqueous electrolytic bath. Examples of other conducting salts are ammonium chloride or sodium chloride, which are usually employed in amounts of from 10 to 150 g/l.

Another essential component of the acidic aqueous electrolytic baths according to the invention are non-ionic and anionic surfactants. Suitable non-ionic surfactants are disclosed, for example, in GB Patent 1 149 106. These are adducts of ethylene oxide with fatty alcohols, eg. $C_8$–$C_{18}$-alcohols, or adducts of ethylene oxide with phenol or alkylphenols, especially nonylphenol. In these cases the adduct as a rule contains from 5 to 100 mol of ethylene oxide per mol of alcohol or phenol.

Suitable anionic surfactants are disclosed, for example, in U.S. Pat. No. 3,787,296. These are mainly sulfated polyethers which can be obtained, for example, by addition of ethylene oxide onto fatty alcohols, fatty amines, amides of $C_6$–$C_{10}$-carboxylic acids and longer-chain fatty acids, and subsequent sulfonation in each case. Sulfonates of polyalkylene oxides or block copolymers of ethylene oxide and propylene oxide are also used as anionic surfactants.

Another group of anionic surfactants is disclosed in European Patent 0 115 020. This describes sulfonated and sulfated alkylphenol ethoxylates which have, for example, the formula II

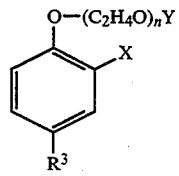

II where $R^3$ is $C_4$–$C_{20}$-alkyl, X and Y are each —$SO_3H$ or —$SO_3Me$, where Me is ammonium, alkali metal or one equivalent of alkaline earth metal or zinc, and n is from 5 to 50.

Apart from the compounds of the formula II, also suitable as anionic surfactants are those sulfonated and sulfated products whose polyether chain contains from 1 to 25 propylene oxide or butylene oxide units.

The advantage of the sulfonated and sulfated alkylphenol alkoxylates is that they have an extremely high cloud point so that the electrodeposition of the zinc can be carried out not only in the conventional temperature range from 20 to 30° C. but also at above 50° C., eg. in the range from 20 to 70° C. The non-ionic and anionic surfactants act as auxiliary brighteners and are simultaneously solubilizers for the compounds I, for example, which are sparingly soluble in water.

These suitable surfactants, as well as phenol/formaldehyde condensation products or naphthalenesulfonic acid/formaldehyde condensation products which can also be employed as surfactants, are normally used in amounts of from 1 to 20 g/l, preferably 2 to 15 g/l, in the acidic aqueous electrolytic baths according to the invention. It is also possible to use a mixture of several surfactants.

It is also advantageous to employ as additional brighteners alkali metal or ammonium benzoates such as, in particular sodium benzoate in amounts of from 1 to 8 g/l, preferably 2 to 6 g/l.

The pH of the acidic aqueous electrolytic baths according to the invention is usually from 4 to 5. It is adjusted by adding acids, eg. conventional mineral acids such as sulfuric acid or hydrochloric acid.

Particularly advantageous results are obtained in zinc coating when in the acidic aqueous baths according to the invention sodium benzoate is employed in an amount of from 1 to 8 g/l as additional brightener and simultaneously the methyl and ethyl ester of 2-benzylideneacetoacetic acid or of 2-benzylidenemalonic acid in a concentration of from 0.05 g to 1 g/l, preferably 0.1 g to 0.7 g/l, is employed as brightener. These combinations have proven particularly useful in acidic aqueous electrolytic zinc baths containing no ammonium salts.

The present application also relates to acidic aqueous electrolytic baths for the electrodeposition of zinc or a zinc alloy as shining coating on shaped articles, where the baths contain as essential components one or more zinc salts and, where appropriate, salts of the other alloy metals, one or more conducting salts, one or more surfactants and one or more brighteners, with an effective content of compounds I.

The process according to the invention galvanizes shaped articles made of metals, mainly iron and steel, in order to protect them from corrosion and simultaneously to confer on them a shining surface. The baths according to the invention used for this purpose provide over the entire industrially suitable range of current densities ductile zinc coatings which are very shiny and whose quality corresponds to that of coatings obtainable with the prior art use of benzylideneacetone.

No adverse effects on the health of those using compounds I have been observed. The compounds I usually have such a low vapor pressure that the possibility of vapors of these compounds entering the human body, for example by inhalation, is a priori very low.

EXAMPLES

The effectiveness of the compounds I in acidic aqueous electrolytic baths for the electrodeposition of zinc is demonstrated using two different baths.

| | |
|---|---|
| Composition of bath 1: | |
| Zinc chloride | 100 g/l |
| Potassium chloride | 200 g/l |
| Boric acid | 20 g/l |
| Commercial naphthalenesulfonic acid/formaldehyde condensation product | 2 g/l |
| Sodium benzoate | 2 g/l |
| Commercial nonylphenol polyethylene glycol ether with 20 ethylene glycol units | 5 g/l |
| Nonylphenol polyethylene glycol ether, sulfonated and sulfated, with 10 ethylene glycol units (disclosed in European Patent 0 115 020) | 10 g/l |
| Brightener specified in table | |
| Composition of bath 2: | |
| Zinc chloride | 100 g/l |
| Ammonium chloride | 140 g/l |
| Sodium benzoate | 6 g/l |
| Commercial nonylphenol polyethylene glycol ether with 20 ethylene glycol units | 10 g/l |
| Nonylphenol polyethylene glycol ether, sulfonated and sulfated, with 10 ethylene glycol units (disclosed in European Patent 0 115 020) | 10 g/l |
| Brightener specified in table | |

The pH of bath 1 was 4.8 and that of bath 2 was 4.5. The pH was adjusted in each case with dilute hydrochloric acid. The zinc coating of steel plates took about 10 minutes in each case. It was carried out in a 250 ml jacketed cell with 1 ampere at about 23° C. The zinc coating was followed by a blue chromating.

The quality of the resulting zinc coatings is shown in the following table. The brightness and ductility of the coatings was assessed visually, scoring as follows 1=poor, 2=slight, 3=moderate, 4=good and 5=very good.

It is evident that the effect of the compounds I employed according to the invention is at least equivalent to the very good effect of benzylideneacetone.

TABLE

| Ex. No. | Brighteners in acidic aqueous electrolytic baths: Brightener: Substance | Brightener: Conc. [g/l] | Bath No. | Result: Brightness | Result: Ductility |
|---|---|---|---|---|---|
| 1 | Ethyl benzylideneacetoacetate | 0.4 | 1 | 4–5 | 5 |
| 2 | Ethyl benzylideneacetoacetate | 0.4 | 2 | 3–4 | 3 |
| 3 | Methyl benzylideneacetoacetate | 0.4 | 1 | 4–5 | 5 |
| 4 | Methyl benzylideneacetoacetate | 0.4 | 2 | 3–4 | 3 |
| 5 | Dimethyl benzylidenemalonate | 0.4 | 1 | 4–5 | 5 |
| 6 | Dimethyl benzylidenemalonate | 0.4 | 2 | 4 | 3 |
| 7 | Diethyl benzylidenemalonate | 0.6 | 1 | 4 | 5 |
| For comparison: | | | | | |
| A | Benzylideneacetone | 0.4 | 1 | 4 | 5 |
| B | Benzylideneacetone | 0.4 | 2 | 3–4 | 3 |

We claim:

1. In a process for the production of shiny shaped articles coated with zinc or a zinc alloy by electrodeposition of zinc or a zinc alloy from acidic aqueous electrolytic baths which contain as essential components one or more zinc salts and, in the case of the alloy, one or more salts of an alloy metal, one or more conducting salts, one or more surfactants and one or more brighteners, the improvement comprising employing a compound (I) of the following formula as a brightener

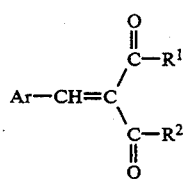

I where $R^1$ is $C_1$–$C_8$-alkoxy, phenoxy, benzyloxy, amino, $C_1$–$C_6$-alkylamino or di($C_1$–$C_6$)alkylamino, $R^2$ is $C_1$–$C_4$-alkyl, phenyl, benzyl or the meanings of $R^1$, and Ar is phenyl or naphthyl which can additionally be substituted by one to three $C_1$–$C_4$-alkyl groups or $C_1$–$C_4$-alkoxy groups.

2. A process for the production of shiny shaped articles coated with zinc or a zinc alloy as claimed in claim 1, wherein $R^1$ is $C_1$–$C_8$-alkoxy, $R^2$ is $C_1$–$C_4$-alkyl or $C_1$–$C_6$-alkoxy, and Ar is phenyl which can additionally be substituted by one or two methyl, ethyl, methoxy or ethoxy groups.

3. A process for the production of shiny shaped articles coated with zinc or a zinc alloy as claimed in claim 1, wherein compound (I) is employed in an amount of from 0.05 g to 3 g per liter of the acidic aqueous electrolytic bath.

4. A process for the production of shiny shaped articles coated with zinc or a zinc alloy as claimed in claim 1, wherein alkali metal or ammonium benzoates are employed as additional brighteners.

5. An acidic aqueous electrolytic bath for the electrodeposition of zinc or a zinc alloy as a shiny coating on shaped articles, comprising: one or more zinc salts, one or more conducting salts, and one or more surfactants and an effective amount of compound (I)

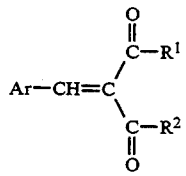

I where $R^1$ is $C_1$–$C_8$-alkoxy, phenoxy, benzyloxy, amino, $C_1$–$C_6$-alkylamino or di($C_1$–$C_6$)alkylamino, $R^2$ is $C_1$–$C_4$-alkyl, phenyl, benzyl or the meanings of $R^1$, and Ar is phenyl or naphthyl which can additionally be substituted by one to three $C_1$–$C_4$-alkyl groups or $C_1$–$C_4$-alkoxy groups.

* * * * *

UNITED STATES PATENT AND TRADEMARK OFFICE

CERTIFICATE OF CORRECTION

PATENT NO. : 5,421,990

DATED : June 6, 1995

INVENTOR(S) : Erwin HAHN, et al.

It is certified that error appears in the above-indentified patent and that said Letters Patent is hereby corrected as shown below:

On the title page, Item [54] and Column 1, Lines 2 and 3, the title should read:

--PRODUCTION OF SHINING SHAPED ARTICLES COATED WITH ZINC OR A ZINC ALLOY--

Signed and Sealed this

Twenty-second Day of August, 1995

*Attest:*

*Attesting Officer*

BRUCE LEHMAN

*Commissioner of Patents and Trademarks*